US005630730A

United States Patent [19]

Wang et al.

[11] Patent Number: 5,630,730

[45] Date of Patent: May 20, 1997

[54] ELECTRICAL CONNECTOR FOR SURFACE MOUNTING TO A PRINTED CIRCUIT BOARD

[75] Inventors: Leland Wang, Hacienda Hts., Calif.; Remo Chen; Johnson Chiu, both of Taipei Hsien, Taiwan

[73] Assignee: Molex Incorporated, Lisle, Ill.

[21] Appl. No.: 324,284

[22] Filed: Oct. 14, 1994

[51] Int. Cl.[6] ..... H01R 13/60

[52] U.S. Cl. ..... 439/567

[58] Field of Search ..... 439/567, 607, 439/569, 570, 571

[56] References Cited

U.S. PATENT DOCUMENTS

| | | | |
|---|---|---|---|
| 3,846,743 | 11/1974 | Garver . | |
| 4,721,472 | 1/1988 | Gentry et al. | 439/79 |
| 4,721,473 | 1/1988 | DelGuidice et al. | 439/79 |
| 4,826,442 | 5/1989 | Douty et al. | 439/92 |
| 4,907,987 | 3/1990 | Douty et al. | 439/571 |
| 4,943,244 | 7/1990 | Teck et al. | 439/567 |
| 5,085,589 | 2/1992 | Kan | 439/567 X |
| 5,129,832 | 7/1992 | Marsh et al. | 439/79 |
| 5,137,245 | 8/1992 | Lee | 439/567 X |
| 5,147,220 | 9/1992 | Lybrand | 439/567 OR |
| 5,238,413 | 8/1993 | McCaffrey et al. | 439/79 |
| 5,249,983 | 10/1993 | Hirai | 439/573 |
| 5,468,160 | 11/1995 | Broschard, III | 439/567 OR |

FOREIGN PATENT DOCUMENTS

| | | |
|---|---|---|
| 0180284 | 10/1985 | European Pat. Off. . |
| 0413156 | 7/1990 | European Pat. Off. . |
| 63-116975 | 1/1987 | Japan . |
| 64-55674 | 9/1987 | Japan . |

*Primary Examiner*—David L. Pirlot
*Assistant Examiner*—Daniel Wittels
*Attorney, Agent, or Firm*—Stacey E. Caldwell

[57] ABSTRACT

A right angle electrical connector is provided for surface mounting to a printed circuit board. The connector includes a dielectric housing having a mounting face. A conductive boardlock is secured to the housing and includes a first substantially planar portion having a leg projecting beyond the mounting face for locking reception in a boardlock-receiving aperture in the printed circuit board. A second substantially planar portion of the boardlock has a foot for connection to a ground trace on the printed circuit board. The first and second portions are substantially perpendicular to each other and to the foot for resisting movement of the connector relative to the printed circuit board in different perpendicular directions.

12 Claims, 4 Drawing Sheets

ELECTRICAL CONNECTOR FOR SURFACE MOUNTING TO A PRINTED CIRCUIT BOARD

FIELD OF THE INVENTION

This invention generally relates to electrical connectors and, particularly, to an electrical connector mountable to a substrate such as a printed circuit board for grounding and locking thereto.

BACKGROUND OF THE INVENTION

In the electronics industry, electrical connectors are mounted to printed circuit boards, such as by right angled mounting, for electrical connection to circuit traces on the boards. Typically, the electrical connectors are mounted onto the printed circuit boards by automated methods, and the electrical connections are made by soldering the connector terminals to the circuit traces on the boards, by reflow or IR methods for example. The connectors may include some form of locking or retention feature to hold the connectors to the boards and, in addition, may include a commoning feature to ground a shield or other component of the connector to a ground trace on the board, often by insertion of a commoning element through a plated-through hole in the printed circuit board.

One type of electrical connector of the character described above is known in the electrical connector industry as a miniature or sub-miniature D connector assembly. The connector assembly includes a plug connector and a receptacle connector, each having an insulative housing containing a plurality of mating terminals or contacts. In order to shield against RF/EM interference, an exterior metal or conductive shell typically encloses the housings. The shielding shells are effectively grounded to the ground traces on the printed circuit board.

One of the problems in utilizing such miniature connectors in conjunction with printed circuit boards is maintaining proper position of the connector and the connector terminals on the board during processing, as well as maintaining the integrity of the solder joints between the connector terminals and the board during subsequent mating and unmating. In particular, right angle configured surface mount connectors, such as board-mounted subminiature D connectors, are asymmetrical and therefore can rock during the processing of the connector to the underlying board, i.e. prior to being soldered to the board. If the rocking is such that the surface mount tails of the terminals are elevated off of the solder pads during soldering, this can result in open circuits or in the connector falling off of the printed circuit board altogether, ultimately causing damage or breakage.

Furthermore, right angle surface mount connectors which have relatively high mating and unmating forces tend to rock and otherwise compromise the integrity of the surface mount solder joints during such mating and unmating. In some applications, "fitting nails" have been added to connector assemblies to relieve some stress inherent in the surface mount terminals. However, since the fitting nails also are surface mounted onto the surface of the board, they frequently cannot pass a standard pulling strength test in the mating direction and, depending on their orientation with respect to the connector assembly, may cause rocking (and potential open circuits), insufficient ground connections or other related problems. In other applications, through-hole boardlocks have been utilized to hold the connector to the underlying printed circuit board both prior to and subsequent to soldering. However, if the retention forces between the connector and the printed circuit board are high, the insertion forces are correspondingly high and, accordingly, the force applied manually or robotically to insert the connector can cause damage to the connector or to the boardlock if there is misalignment or inaccurate placement.

It therefore is important in surface mount applications, and particularly in right angle surface mount applications, to adequately hold the connector to the printed circuit board both during processing and assembly of the connector to the board and thereafter, to prevent open circuits during soldering and to assure the ongoing connection of each lead to the printed circuit board. The present invention is directed to satisfying that need and solving the problems discussed above.

SUMMARY OF THE INVENTION

An object, therefore, of the invention is to provide a new and improved electrical connector of the character described for mounting to a substrate such as a printed circuit board.

In the exemplary embodiment of the invention, an electrical connector is provided for surface mounting to a printed circuit board. The connector includes a dielectric housing having a front face, a rear portion and a base portion with a mounting face mountable to the printed circuit board. A conductive boardlock is secured to the housing and includes a first portion having a leg projecting beyond the mounting face for locking reception in a boardlock-receiving aperture in the printed circuit board. A second portion of the boardlock has a foot for connection to a ground trace on the printed circuit board. The first and second portions are generally planar and generally perpendicular to each other for resisting movement of the housing relative to the printed circuit board in different perpendicular directions.

As disclosed herein, the connector includes a conductive shield positionable against the front face of the housing. The second portion of the boardlock is adapted for commoning the conductive shield to the ground trace on the printed circuit board.

The preferred embodiment contemplates stamping and forming the boardlock of sheet metal material, with the first and second portions thereof comprising plate-like portions. The leg of the first portion of the boardlock is generally coplanar therewith. The foot of the second portion of the boardlock is generally planar and generally perpendicular to the second portion. The leg of the first portion of the boardlock is of a size and configuration relative to the boardlock-receiving aperture so as to be confined within the bounds of the aperture and not project through the printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
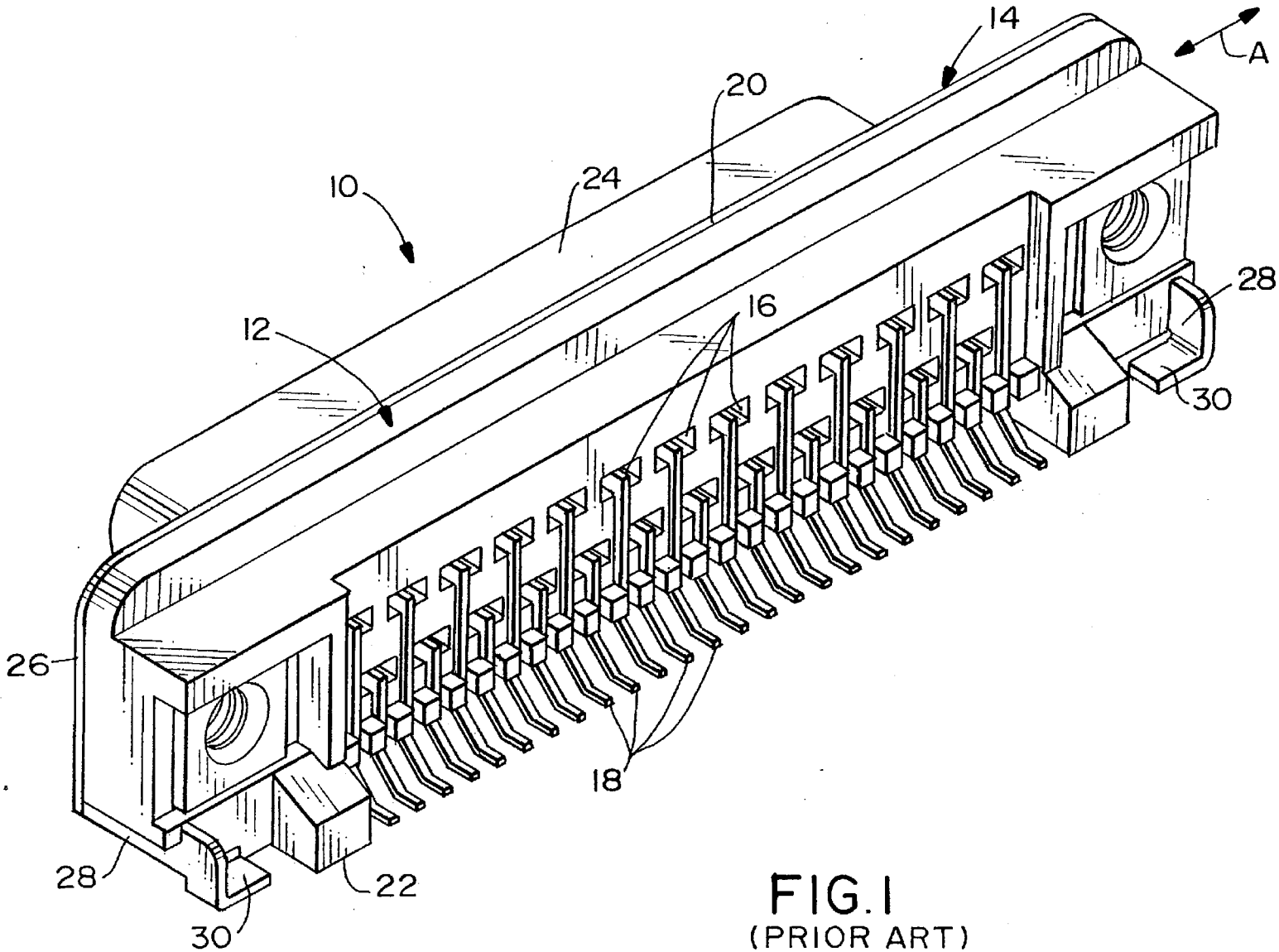
FIG. 1 (PRIOR ART)
FIG. 1 is a perspective view of a prior art electrical connector.
Figure 2:
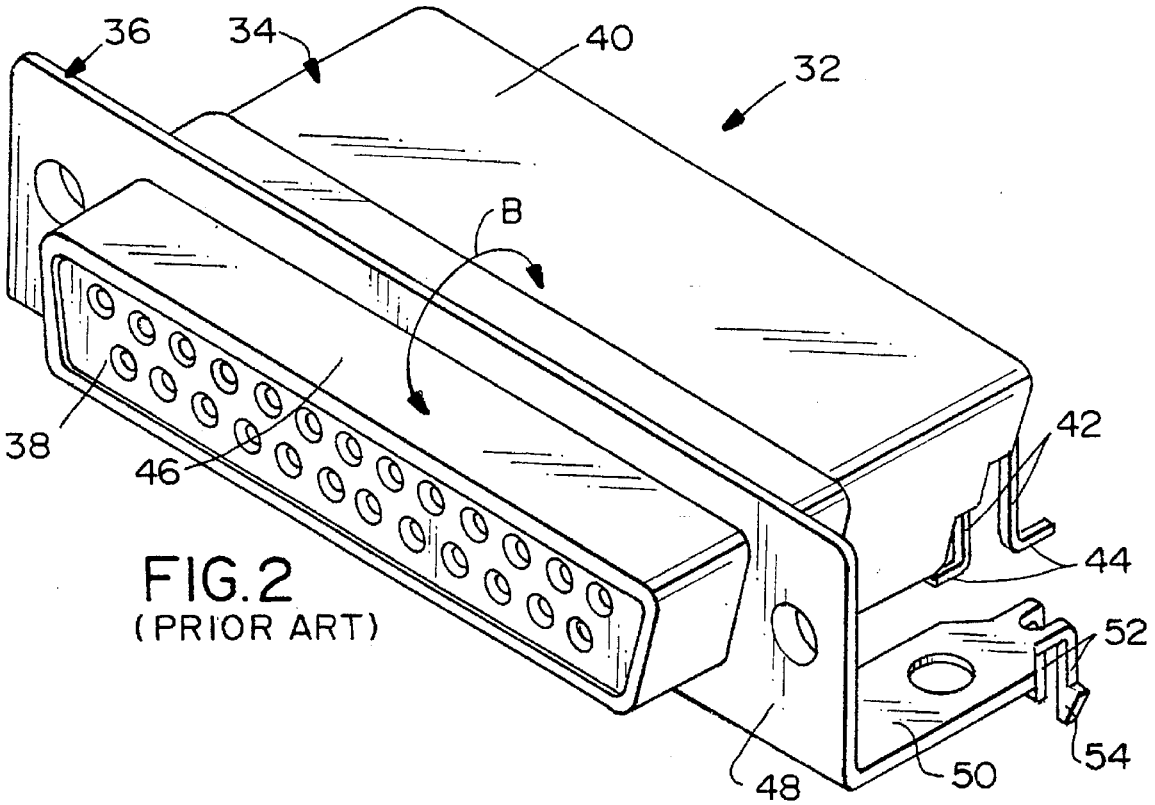
FIG.2 (PRIOR ART)
FIG. 2 is a perspective view of another prior art electrical connector.

Referring to the drawings in greater detail, FIGS. 1 and 2 show examples of prior art shielded electrical connectors for surface mounting on a printed circuit board (not shown) and which employ means for commoning the shield of the connector to a ground trace on the printed circuit board and means for providing a boardlock to secure the connector to the board.

Referring first to FIG. 1, a prior art electrical connector, generally designated 10, is shown as a miniature or sub-miniature D connector. The connector includes a unitary dielectric or insulative housing, generally designated 12, a conductive shield, generally designated 14, and a plurality of terminals 16 mounted in the housing, with the terminals including tail portions 18 for soldering to circuit traces on the printed circuit board.

Housing 12 of connector 10 includes a front face 20 and a mounting face 22 mountable to the printed circuit board. In essence, the tail portions or feet 18 of terminals 16 and mounting face 22 are coplanar for surface mounting the connector to the printed circuit board.

Shield 14 of connector 10 includes a shroud portion 24 defining the mating end of the connector and within which terminals 16 extend for interconnection to the terminals of a complementary mating connector (not shown). The shield also includes a peripheral flange portion 26 positionable against front face 20 of housing 12. An integral ground strap 28 projects rearwardly of peripheral flange 26 at each end thereof and terminates in a foot 30 for soldering to a ground trace on the printed circuit board. Feet 30 are coplanar with mounting face 22 of housing 12 and tail portions 18 of terminals 16.

One of the problems with prior art connector 10 is that it does not include any boardlocks for securing the connector to the printed circuit board during the processing of the connector, and in particular the tail portions of the terminals to the circuit traces on the board. In addition, ground straps 28 and feet 30 do not resist movement of the connector relative to the printed circuit board in the direction of double-headed arrow "A". Specifically, it can be seen that ground straps 28 are generally planar, such as of sheet metal material, and are in planes generally perpendicular to arrow "A" which, in essence, defines the longitudinal axis of the connector. Therefore, with the ground straps being in planes perpendicular to the longitudinal axis, the ground straps can bend rather than resisting relative movement between the connector and the board in the direction of double-headed arrow "A".

FIG. 2 shows another example of a miniature or sub-miniature D connector, generally designated 32, of the prior art. Again, the connector includes a dielectric housing, generally designated 34, and a shield, generally designated 36. The housing includes a forward mating portion 38 and a rear portion 40 mounting a plurality of terminals 42 having feet portions 44 for surface soldering to circuit traces on a printed circuit board.

Shield 36 of connector 32 again includes a forwardly projecting shroud portion 46 and a peripheral flange portion 48. A ground strap 50 projects rearwardly of peripheral flange 48 at each opposite end thereof. The straps include integral leg portions 52 for insertion into mounting holes in the printed circuit board. The legs have hooks 54 for snappingly locking against the bottom side of the board. Legs 52 may perform a dual function of providing boardlock means for connector 32 as well as grounding means for connection to ground traces on the board and/or in the mounting holes.

A problem with prior art connector 32 is that the connector can "rock" about the longitudinal axis of the connector in the direction of double-headed arrow "B" both during processing (IR or wave soldering) and during subsequent mating and unmating of the connector. In other words, it can be seen that peripheral flange 48, ground straps 50 and boardlock legs 52 all are in various planes that extend generally parallel to the longitudinal axis of the connector. Therefore, those planar components can bend and allow the connector to rock in the direction of arrow "B". Furthermore, the hooks 54 of leg portions 52 are adapted to latch against the underside of the printed circuit board, and are therefore not amenable to "true" surface mount applications (i.e. applications in which all features of a component lie within the plane of the mounting substrate without extending through to the opposite side of a mounting surface.

Figure 3:
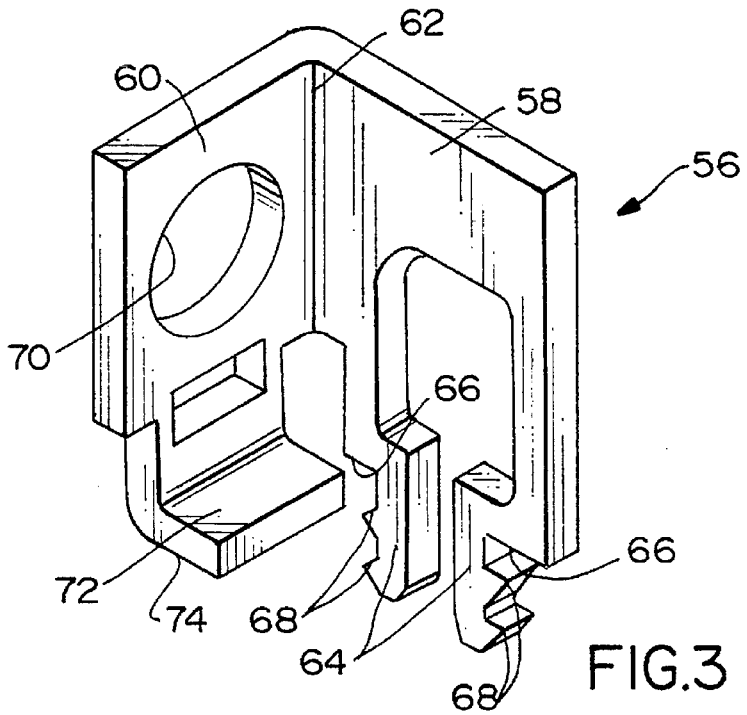
FIG. 3 is a perspective view of the boardlock of the invention.

FIG. 3 shows a boardlock, generally designated 56, according to the invention. The boardlock is unitarily fabricated of conductive sheet metal material. The boardlock includes a first, generally planar portion 58 and a second, generally planar portion 60. The first and second planar portions are generally perpendicular to each other as defined by an approximately 90° bend 62 therebetween. Therefore, the boardlock is capable of resisting forces in different perpendicular directions as defined by the perpendicular planes.

First planar portion 58 of boardlock 56 includes a pair of legs 64 projecting downwardly from abutment shoulders 66. As will be seen hereinafter, the legs are adapted to be inserted into a mounting hole or aperture in a printed circuit board, with abutment shoulders 66 abutting against the top surface of the board. The legs have given lengths so as to be confined within the bounds of the mounting hole in the board, and the legs have outwardly projecting teeth 68 for biting into the material of the substrate of the printed circuit board within the hole.

Second planar portion 60 of boardlock 56 includes a mounting hole 70 for purposes to be described hereinafter, along with a generally planar foot 72 for connection, as by soldering, to a ground trace on the top surface of the printed circuit board. A bottom surface 74 of foot 72, therefore, is generally coplanar with abutment shoulders 66 at the lower end of first planar portion 58.

Figure 4:
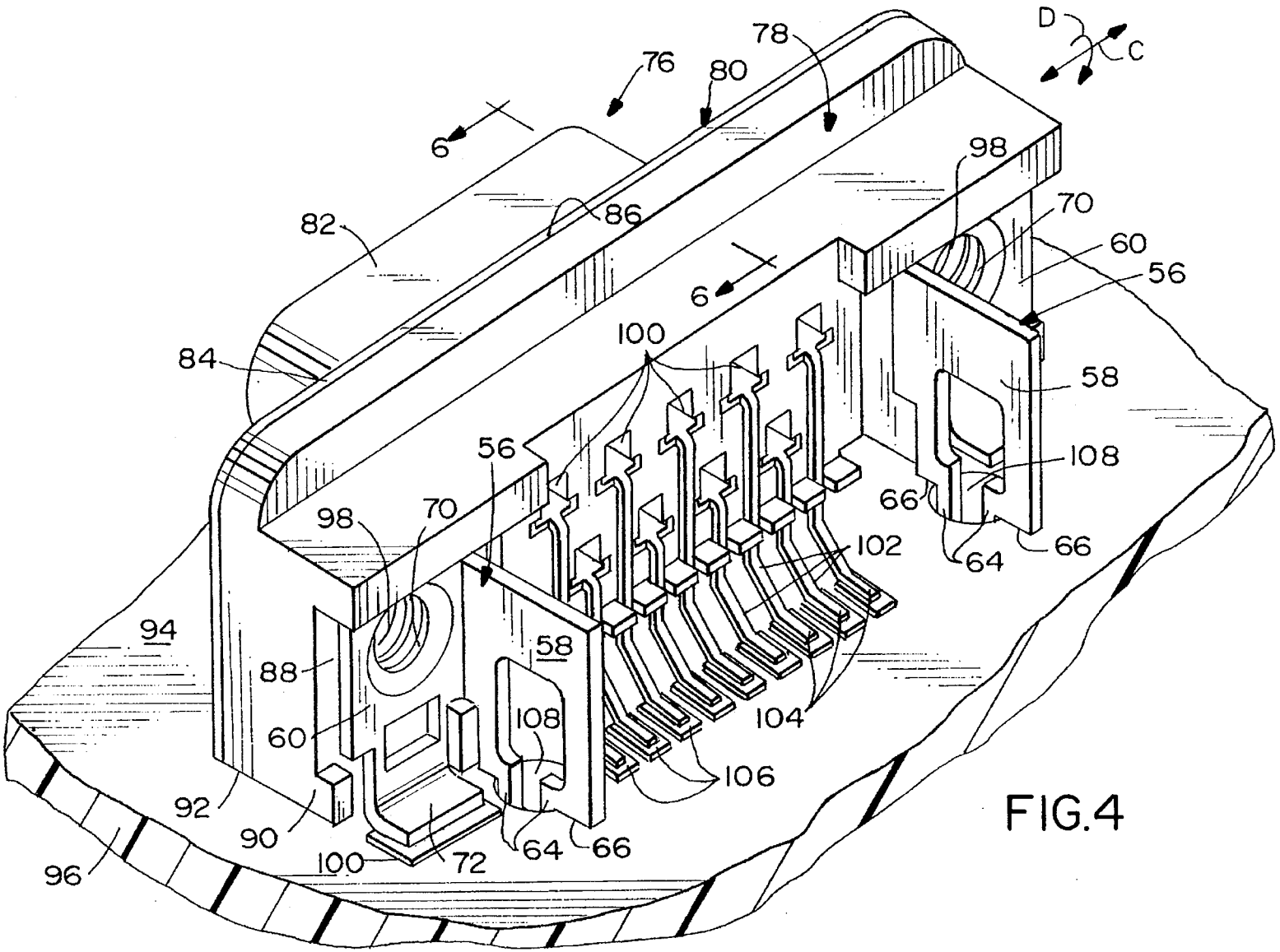
FIG. 4 is a perspective view of an electrical connector incorporating a pair of the boardlocks of the invention, mounted to a printed circuit board.
Figure 5:
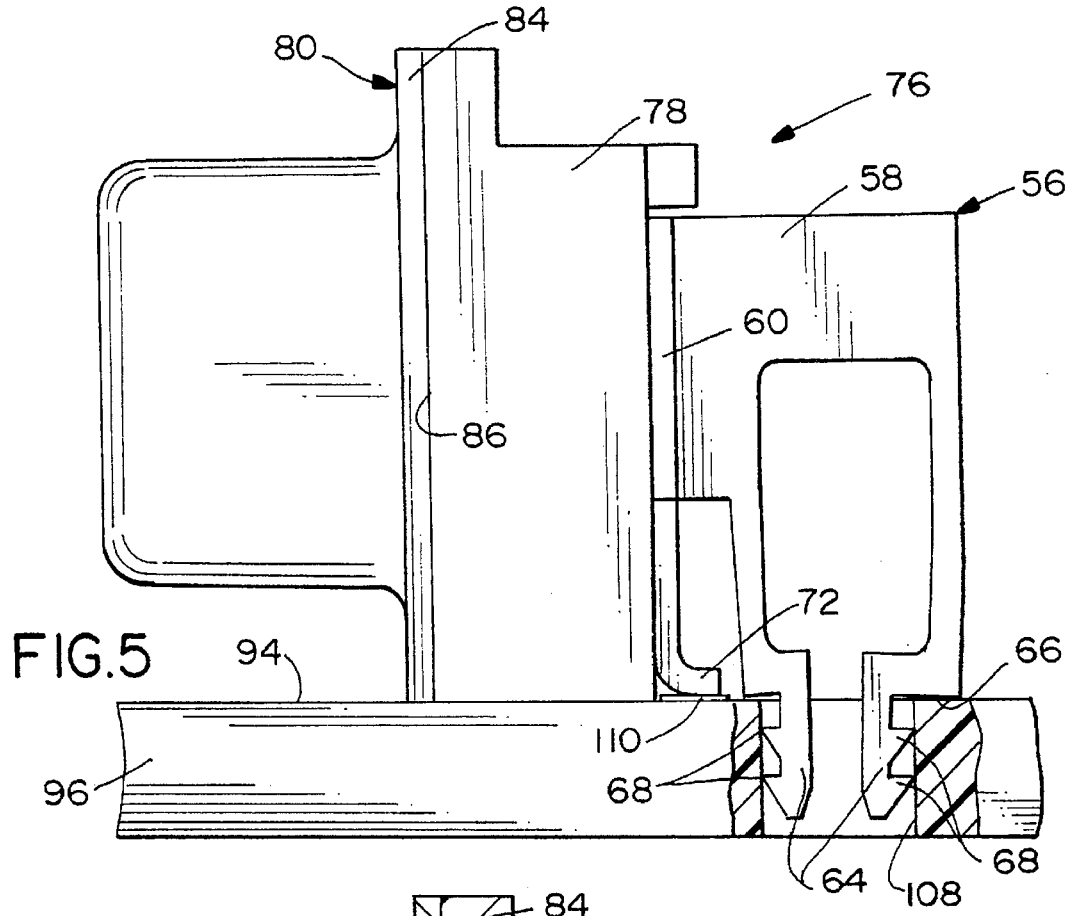
FIG. 5 is an end elevational view of the electrical connector and printed circuit board of FIG. 4.
Figure 6:
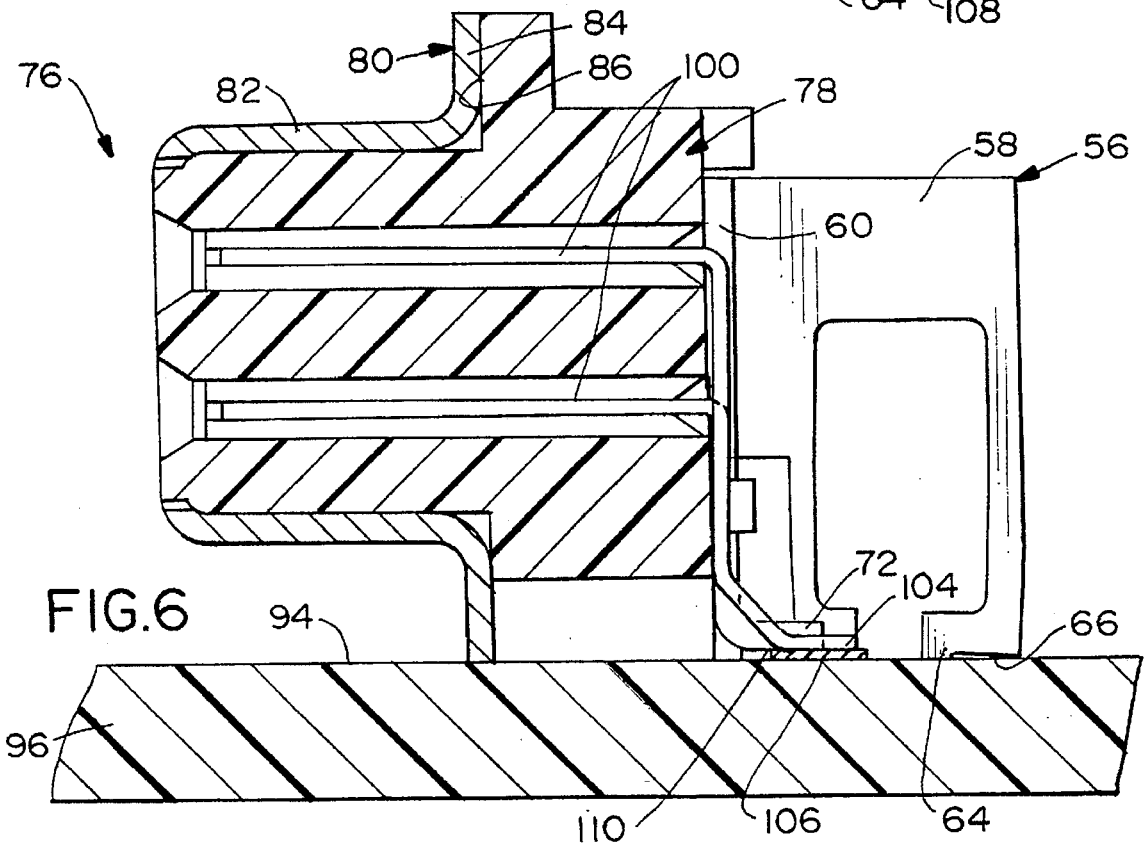
FIG. 6 is a vertical section taken generally along line 6—6 of FIG. 4.

FIGS. 4–6 show boardlocks 56 employed in a miniature or sub-miniature D connector, generally designated 76. Like connector 10 (FIG. 1) and connector 32 (FIG. 2), connector 76 includes a dielectric housing, generally designated 78, and a conductive shield, generally designated 80. Again, the shield includes a forward mating shroud portion 82 and a peripheral flange portion 84 which is positionable against a front face 86 of housing 78.

Housing 78 of connector 76 includes a rear portion 88 and a base portion 90 having a mounting face 92 for mounting to a top surface 94 of a printed circuit board 96. Boardlocks 56 are mounted to rear portion 88 of the housing, and the mounting hole 70 of each boardlock is aligned with a hole 98 through the housing. A pair of conductive rivets, bolts or the like are used to common boardlocks 56 with shield 80 through holes 98 in the housing. A plurality of terminals 100 are mounted within the housing, the terminals including solder tails 102 having feet portions 104 connected to circuit traces 106 on printed circuit board 96, as by soldering.

As seen best in FIGS. 4 and 5, legs 64 of boardlocks 56 project into mounting holes or apertures 108 in the printed circuit board. FIG. 5 shows that the legs do not project through the board, and teeth 68 are shown in engagement with the inside surface or wall of respective mounting hole 108.

FIGS. 4–6 show that feet 72 of boardlocks 56 are connected, as by soldering, to ground traces 110 on the top surface 94 of printed circuit board 96. Therefore, a commoning path is formed between ground traces 110 and shield 80 through boardlocks 56 and the rivets or bolts that extend through holes 98 in the housing to common the boardlocks with the shield.

Referring to FIG. 4, the functional advantages of the construction of boardlocks 56 can be best understood with reference to double-headed arrow "C" which can be used as defining the longitudinal axis of connector 76. The connector is asymmetrical relative to this axis and the connector has a tendency to rock in the direction of double-headed arrow "D" both during processing (e.g. IR or wave soldering) of the connector as well as during use of the connector. In addition, the connector can be subjected to external forces longitudinally of the connector, i.e. in the direction of double-headed arrow "C". In essence, the potential longitudinal movement ("C") is generally perpendicular to the potential rocking movement ("D") of the connector relative to the printed circuit board. Since typically in a surface mount application the connector rests unsecured on the surface of the substrate or underlying printed circuit board prior to processing, any force applied to the connector prior to or during processing can compromise the location of solder tails 102 relative to circuit traces 106.

With first planar portions 58 of boardlocks 56 being generally perpendicular to the longitudinal axis ("C"), the first planar portions resist the relative rocking movement between the connector and the board. With second planar portions 60 of boardlocks 56 being generally parallel to potential longitudinal movement (i.e. double-headed arrow "C") of the connector relative to the printed circuit board, the second planar portions resist such relative movement between the connector and the board.

In summation, it can be understood that each single boardlock 56 performs multiple functions of (1) locking the connector within mounting holes 108 of the printed circuit board, (2) grounding shield 80 of the connector to ground trace 110 of the printed circuit board, (3) resisting rocking movement of the connector relative to the board as indicated by double-headed arrow "D" and (4) resisting axial movement of the connector relative to the board in the longitudinal direction as indicated by double headed arrow "C". Second planar portion 60 may, for example, include a pair of legs similar to legs 64 of first planar portion 58 instead of planar foot 72. The ground connection therefore would be made between projecting teeth on the legs and a plated internal surface of a second aperture. Another alternative would be to make the ground connection between first planar portion 58 and the walls of aperture 108 (aperture 108 would be plated-through in such an application). Planar foot 72 could either be eliminated altogether, or could remain as a strain relief and be soldered to a dummy circuit pad, depending on the application. Accordingly, the present examples and embodiments, therefore, are to be considered in all respects as illustrative and not restrictive, and the invention is not to be limited to the details given herein.

It will be understood that the invention may be embodied in other specific forms without departing from the spirit or central characteristics thereof.

We claim:

1. An electrical connector for surface mounting to a printed circuit board, comprising:

a dielectric housing having a mounting face and a front mating face, the mounting face being substantially perpendicular to the front mating face; and a stamped and formed conductive boardlock secured to the housing and including a first substantially planar portion having a projection extending beyond said mounting face for locking reception in a boardlock-receiving aperture in the printed circuit board and a second substantially planar portion having a foot for connection to a ground trace on the printed circuit board, the first and second portions being substantially perpendicular to each other and to the foot for resisting movement of the connector relative to the printed circuit board in different perpendicular directions.

2. The electrical connector of claim 1 wherein said projection comprises two substantially parallel legs each having projecting teeth formed thereon for interferingly engaging the interior wall of the boardlock-receiving aperture.

3. The electrical connector of claim 2 wherein the legs of said first portion of the boardlock are of a size and configuration relative to the boardlock-receiving aperture so as to lie within the plane of the printed circuit board.

4. The electrical connector of claim 2 wherein the legs and teeth of said first portion of the boardlock are substantially coplanar with said projection.

5. An asymmetrical electrical connector for surface mounting to a printed circuit board, comprising:

a dielectric housing defining a front face, a rear portion and a base portion with a mounting face mountable to the printed circuit board, wherein said front face is substantially parallel to said rear portion and substantially perpendicular to said mounting face;

a conductive shield positionable against the front face of the housing; and a stamped and formed conductive boardlock positionable against the rear portion of the housing and including a first substantially planar portion substantially perpendicular to said rear portion and having a projection which extends beyond said mounting face for locking reception in a boardlock-receiving aperture in the printed circuit board and a second substantially planar portion substantially perpendicular to the first substantially planar portion and having a foot formed substantially perpendicular to the first and second planar portions for connection to a trace on the printed circuit board.

6. The electrical connector of claim 5 wherein the second substantially planar portion of said boardlock is adapted for commoning the conductive shield to the ground trace on the printed circuit board.

7. The electrical connector of claim 5 wherein said projection comprises two substantially parallel legs each having projecting teeth formed thereon for interferingly engaging the interior wall of the boardlock-receiving aperture.

8. The electrical connector of claim 7 wherein the legs of said first portion of the boardlock are of a size and configuration relative to the boardlock-receiving aperture so as to lie within the plane of the printed circuit board.

9. The electrical connector of claim 5 wherein said second substantially planar portion has an aperture formed therein for reception of a conductive element which extends through the housing and electrically commons the conductive boardlock and the conductive shield.

10. A boardlock for retaining a right angle shielded electrical connector to a printed circuit board and for commoning the shielded connector to a ground trace on the printed circuit board, the connector including a dielectric housing defining a front face, a rear portion and a base portion with a mounting face mountable to the printed circuit board, and a conductive shield positionable against the front face of the dielectric housing, the boardlock comprising:

a stamped and formed conductive member positionable against the rear portion of the dielectric housing and including a first substantially planar portion having a pair of legs projecting beyond said mounting face for locking reception in a boardlock-receiving aperture in the printed circuit board, the first portion being substantially perpendicular to the front and mounting faces of the housing, and a second substantially planar portion substantially perpendicular to the first substantially planar portion and having one end for connection to the printed circuit board, the second portion being substantially parallel to the front face and substantially perpendicular to the mounting face of the housing, and being commoned to the conductive shield by way of a conductive element extending through the dielectric housing.

11. The boardlock of claim 10 wherein said second substantially planar portion of the conductive member is positionable against the rear portion of the housing and each of the conductive shield, the dielectric housing and the conductive member includes coaxial apertures formed therein which receives the conductive element and commons the conductive member to the conductive shield through the housing.

12. The boardlock of claim 10 wherein the pair of legs of said first portion is of a size and configuration relative to the boardlock-receiving aperture so as to lie within the plane of the printed circuit board.

* * * * *